US007866351B2

(12) United States Patent
Hamann

(10) Patent No.: US 7,866,351 B2
(45) Date of Patent: Jan. 11, 2011

(54) TOOL FOR CLAMPING AND TWISTING OF WIRES

(76) Inventor: Peter Hamann, 272 River Bend Way, Del Rio, TN (US) 37727

( * ) Notice: Subject to any disclaimer, the term of this patent is extended or adjusted under 35 U.S.C. 154(b) by 618 days.

(21) Appl. No.: 10/948,377

(22) Filed: Sep. 23, 2004

(65) Prior Publication Data

US 2005/0067183 A1 Mar. 31, 2005

Related U.S. Application Data

(60) Provisional application No. 60/506,292, filed on Sep. 25, 2003.

(51) Int. Cl.
*B21F 15/06* (2006.01)

(52) U.S. Cl. ..... 140/118; 140/149; 29/748

(58) Field of Classification Search ..... 29/745–749, 29/751, 758, 762, 729, 739; 81/124.4, 121.1, 81/9.4, 125; 72/409.13; 140/118, 117, 149; 7/107, 164, 165, 119
See application file for complete search history.

(56) References Cited

U.S. PATENT DOCUMENTS

| | | | | |
|---|---|---|---|---|
| 699,164 | A * | 5/1902 | Gorsuch | 140/119 |
| 2,898,952 | A * | 8/1959 | Lovecky | 242/439.1 |
| 2,949,939 | A | 8/1960 | Milla | |
| 2,998,034 | A * | 8/1961 | Mann et al. | 140/123 |
| 3,163,187 | A * | 12/1964 | Macintosh | 140/93.6 |
| 3,787,948 | A | 1/1974 | Runge | |
| 4,074,732 | A | 2/1978 | Wilkens | |
| 4,227,040 | A | 10/1980 | Scott | |
| 4,823,650 | A | 4/1989 | Tuttle | |
| 4,865,086 | A | 9/1989 | Robinson | |
| 5,260,515 | A | 5/1992 | Braun, Jr. | |
| 5,379,809 | A | 1/1995 | Waulk | |
| 5,501,251 | A * | 3/1996 | Vader et al. | 140/53 |
| 5,887,631 | A | 3/1999 | Eaton | |
| 6,354,176 | B1 * | 3/2002 | Nordlin | 81/124.4 |
| 6,784,370 | B1 | 8/2004 | Keswani et al. | |
| 7,051,392 | B2 * | 5/2006 | Dominguez | 7/164 |
| 7,104,287 | B1 * | 9/2006 | Schmitz | 140/118 |
| 7,124,786 | B1 * | 10/2006 | Gowhari | 140/118 |
| 2002/0069715 | A1 | 6/2002 | Genco | |

OTHER PUBLICATIONS

Gregory, G. D. "Using Arc-Fault Circuit Interrupters to Reduce Residential Fires", Nov. 1, 1997, EC&M, PRIMEDIA Business Magazines.

NFPA. "Electricity and Fire", NFPA 921 Guide for Fire and Explosion Investigations, 1998, Section 14-9.2 National Fire Protection Association, Boston.

(Continued)

*Primary Examiner*—Minh Trinh
(74) *Attorney, Agent, or Firm*—Kenyon Potter

(57) ABSTRACT

A tool for twisting of the bare ends of electrical wires or conductors or connectors while simultaneously restraining rotation of wires at a predetermined distance from their bare ends. The tool reduces repetitive motion of the user when making electrical connections and can also enables the user to make more secure electrical connections. The various embodiments illustrate the invention as a hand tool or in conjunction with a power tool.

1 Claim, 7 Drawing Sheets

OTHER PUBLICATIONS

Slade, P.G. Electrical Contacts: Principles and Applications, 1999, p. 157-158 & 288-290, Marcel Dekker, Inc., New York, NY.

Wentz, M. "Using tools: Connect wire right; Simple tools & techniques for faster, safer connections", Apr. 1, 1999. Handyman. Home Service Publications, Inc.

Babrauskas, V., "How Do Electrical Wiring Faults Lead to Structure Ignitions?" Proc. Fire and Materials Conference, 2001, pp. 39-51, Interscience Communications Ltd., London.

Barber, J.R. "Bounds on the electrical resistance between contacting elastic rough bodies", Nov. 1, 2002, 53-66, vol. 459, Royal Society, London, England.

Shackman, N. "The Trouble with Torque in Electrical Connections: Torque and Force are not the same", Nov. 2002, Maintenance Technology.

Haynes, G. "Have We Sparked Our Last Home Fire?", Feb. 2003, Expert Law.

Shackman, N. "Creating Reliable Electrical Connections", May 2003, Maintenance Technology.

Anonymous, "Wire Termination—WireNut Table", Product Catalog, viewed Jun. 23, 2003. Ideal Industries, Inc.

Gregory, G. D. et al. "Applying and Using Arc-Fault Circuit Interrupters", Mar. 1, 2004, EC&M, PRIMEDIA Business Magazines.

Gorton, J. "Using Tools: Tips for safer wiring", Jul. 1, 2004. Handyman. Home Service Publications, Inc.

* cited by examiner

TOOL FOR CLAMPING AND TWISTING OF WIRES

PRIORITY CLAIM

The benefit under 35 U.S.C. Section 119(e) of U.S. Provisional Application No. 60/506,292, filed on Sep. 25, 2003, and entitled "Compact Tool for Clamping and Twisting of Electrical Wires or Conductors" is hereby claimed. U.S. Provisional Application No. 60/506,292 is hereby incorporated by reference in its entirety.

COPYRIGHT RIGHTS

A portion of the disclosure of this patent document contains material that is subject to copyright protection. The copyright owner has no objection to the facsimile reproduction by anyone of the patent document or of the patent disclosure as it appears in the U.S. Patent and Trademark Office patent files or records, but otherwise reserves all copyright rights whatsoever.

FIELD OF THE INVENTION

This invention relates to devices for making wiring connections, and in particular, to devices for making electrical connections between bare ends of wires or conductors.

BACKGROUND OF THE INVENTION

In residential construction, electrical wiring is generally organized in branch circuits. Wiring in branch circuits generally serves multiple devices with varied electrical loads. Hence, wiring runs from one electrical device to another device within the branch circuit rather than directly from the electrical panel. As a result, the wiring is discontinuous due to the termination of one or more conductors at each electrical device. Therefore, to achieve a continuous branch circuit necessitates an electrical connection at each electrical device.

Electrical wiring may also be discontinuous due to presence of one or more sub-branches within a branch circuit. Sub-branches may lead to such electrical devices as receptacles, switches, lights, fixtures, and so on. Similar to discontinuities in a branch circuit, a discontinuity in a sub-branch necessitates an electrical connection. As a result, the wiring is discontinuous due to the termination of one or more conductors at the sub-branch (or junction). Therefore, to achieve a continuous circuits necessitates a connection at the sub-branch or junction.

In some cases, a branch circuit may be dedicated to a single electrical device (or load) such as a major appliance. Yet, wiring may still be discontinuous due to accidental damage to wiring, unanticipated terminations of conductors, alterations to electrical plans, and/or particular methods employed by an electrician or construction worker. As a result, the wiring is discontinuous due to the termination of one or more of its conductors at the intermediate connection. In such cases, an intermediate connection (or splice) may be necessary between the electrical panel and the electrical device (or load) to achieve a continuous circuit.

At an electrical device, an electrical connection comprises the connection of a plurality of conductors to the electrical device. Typically, an electrical connection at a device comprises the connection of three conductors: hot(+), neutral(−), and ground coated with insulation colored "black", "white", and "green", respectively. Alternatively, the ground conductor may be uninsulated (or its ends may be stripped bare). An electrical connection may have four or more conductors to provide, for example, 3-way controls. Such 3-conductor or 4-conductor electrical connections are often achieved by wire-to-terminal connections.

In a wire-to-terminal connection, a conductor is wound about around a screw and the screw is tightened to clamp at least one conductor to a terminal. A winding may range from 90 to 360 degrees (typically 150 to 220 degrees). Many common electrical devices such as switches and receptacles include terminals and buses for facilitating these connections. These devices typically provide a pair of terminals (yellow brass) connected by a first bus for connecting the terminus of at least one hot(+) conductor; a pair of terminals (white brass) connected by a second bus for connecting the terminus of at least one neutral(−) conductor; and a single terminal for connecting a ground conductor to the device.

However, other types of common devices do not provide terminals to facilitate connections. For example, such devices may include electronic dimmers, ballasts, lights, fans, motors, and other devices. In their design and/or manufacture, these devices are frequently sealed and provide only leads: hot(+), neutral(−), and ground for making connections. As a result, making wire-to-terminal connections is not feasible.

Further, even if a device has screw-type terminals, a typical device has only two pairs of terminals. Spare terminals may be unavailable due to connections of a sub-branch, a switched receptacle, or 3-way lighting controls. One solution is to use a single terminal to connect multiple conductors. However, the number of conductors per terminal is limited by manufacturer specifications and code requirements. Another solution is to employ multiple devices in side-by-side configuration in an electrical box known as a quad. However, due to aesthetics side-by-devices may only be acceptable for certain types of devices and in certain locations where extra devices are acceptable and sometimes beneficial. For example, providing extra receptacle devices may be beneficial if so doing increases the likelihood of available receptacles (and obviates the need for extension cord). An extra receptacle device is sometimes needed when the buses on a receptacle device are severed and the device is wired so that one receptacle is controlled by a switch. For example, providing extra switches may be beneficial if so doing increases the user control of the lighting (and obviates the need for overlighting the whole room). An extra switch is needed when, as discussed above, a receptacle is controlled by a switch. Yet, if sufficient receptacles already exist, providing extra receptacles may be unnecessary and thus inefficient. For these reasons, another type of connection is required.

An electrician often makes an electrical connection between a plurality of conductors by using a twist-on connector of the type manufactured by Ideal Industries, Inc. of Sycamore, Ill., under trademark or tradename "Wire Nut" or "Wire Connector". A purpose of the twist-on connector is to provide insulation to bare wires as required by code. Another purpose of the twist-on connector is to make an electrical connection between the bare wires by pressing together the bare wires. Another purpose of the twist-on connector is to twist the bare wires. According to a leading manufacturer, pre-twisting of the bare ends of the conductors is not required prior to application of the twist-on connector. However, the twist-on connector would appear to have limited effectiveness for this purpose. This is particularly true for solid wires which require application of torque to achieve sufficient rotation.

Unfortunately, faulty wiring such as loose electrical connections represents a fire hazard and a common cause of fires in residential construction. In a recent study, a small point of contact between two conductors was shown to cause the temperature around the point of contact to significantly exceed a safe operating temperature without tripping a circuit breaker (or blowing a fuse). Although a circuit breaker is expected to trip (or fuse) due to current overload, the current did not overload but instead funneled through the small point of contact similar to an undersized conductor. Hence, achieving increased area of contact between conductors would reduce the operating temperature. Therefore, it is recognized that it is best practice to pre-twist the bare ends of conductors together prior to capping with a twist-on connector.

An experienced electrician often twists the bare ends of two or more conductors together using a pliers or the like. Yet, a novice or a do-it-yourselfer ("DIY"), and sometimes even an electrician, may fail to pre-twist the bare ends. Conductors may range in size from 6 ga to 24 ga. and may comprise solid and/or braided wires; conductors typically range in size from 10 ga to 14 ga. and typically comprise a plurality of solid wires. As a result of twisting, the number of rotations in the bare ends may range from about 0.5 to 4 rotations (or $1\pi$ to $8\pi$ radians); the number of rotations is typically from ¾ to 2 rotations (or $3\pi/2$ to $4\pi$ radians). By pre-twisting the wires, the connection is more likely to be mechanically sound, and therefore, electrically sound as well.

The prior art shows many examples of tools for working of electrical wire including combination tools for cutting, stripping, crimping, bending of wire as well as twisting of wire. For example, U.S. Pat. Nos. 1,699,805; 3,654,647; and 6,473,925 describe pliers for working wire including cutting, stripping, and twisting wire. However, each tool requires the repositioning of tool and wires to perform twisting. Additionally, patents '805, '647, and '925 do not teach the capability to restrain rotation of wires or conductors so that twisting is confined to the bare ends of conductors. Therefore, each tool lacks the capability to assure sufficient contact area between or among the bare ends of the conductors.

The prior art shows several examples of tools for twisting electrical wire. U.S. Pat. Nos. 4,074,732; 5,379,809; and 5,887,631 teach a hand tool for twisting a plurality of wires or conductors. U.S. Pat. No. 4,865,086 teaches a type of socket for use in conjunction with a hand tool or power tool for twisting a plurality of wires or conductors. U.S. Pat. No. 5,379,809 also teaches a device for twisting the bare ends of wires or conductors. However, each tool lacks the capability to restrain the rotation of the wires or conductors so that twisting is confined to the bare ends of the wires or conductors. Therefore, each tool also lacks the capability to assure sufficient contact area between or among the bare ends of the conductors because rotation is not confined to the bare ends of the conductors. Additionally, each tool teaches a socket or receiving element which has blades, ridges, or the like on its interior. Therefore, the tool teaches a socket which requires a more complicated method of manufacture than is necessary to achieve rotation of the tips of the bare ends of wires or conductors.

The prior art also shows several examples of tools intended for twisting of conductors using a twist-on connector of the type manufactured by Ideal Industries Inc. U.S. Pat. Nos. 2,959,995 and 4,823,650; and 5,887,631 teach tools for twisting of a twist-on connector to operatively couple a plurality of wires. U.S. Pat. Nos. '995 and '650 teach tools which lack the capability to assure sufficient contact area between or among the bare ends of conductors because the '995 and '650 patents do not teach the need to pre-twist the bare ends of the wires or conductor. Therefore, each tool teaches an electrical connection which relies on the twist-on connector, and is generally of marginal quality due to insufficient contact area between or among conductors. U.S. Pat. No. '631 teaches a tool for applying a twist-on connector to a plurality of wires or conductors which are pre-twisted. However, the electrical connection may still not have sufficient contact area between or among conductors because the tool lacks the capability to restrain the rotation of the wires or conductors so that twisting is confined to the bare ends of the wires or conductors. Therefore, to pre-twist the conductors, the '631 patent teaches a tool which requires a user to perform a greater number of twists whose sum exceeds 3 rotations ($6\pi$ radians) and possibly up to 10 rotations ($20\pi$ radians) than necessary since from ¾ to 2 rotations (or $3\pi/2$ to $4\pi$ radians) may assure sufficient contact area between or among the bare ends of the conductors when the rotation of the conductors are effectively restrained.

None of the prior art teach a tool for restraining rotation of wires or conductors during twisting except for U.S. Pat. No. 2,949,939 which teaches device for clamping and twisting of conductors which is mounted on a work bench, table, or other level surface. However, patent '939 teaches a complicated clamping mechanism which is not amendable to efficient operation in that the mechanism requires an additional step or steps to clamp and release of the conductors. Additionally, patent '939 teaches a tool having such size and weight and that it lacks the portability and is, therefore, extremely impractical as a hand tool.

SUMMARY OF THE INVENTION

The present invention overcomes the disadvantages of the prior art because the invention teaches a hand tool capable of twisting bare ends of a plurality of conductors while simultaneously restraining the rotation of conductors at a predetermined length from the tips of the bare ends of the conductors. Restraining the rotation of the conductors is accomplished by the invention's simple clamping mechanism which grips and releases wires or conductors with ease. The simple clamping mechanism is a forceps, tongs, or the like which grips the conductors with sufficient force to prevent rotation. Twisting of the bare ends conductors is accomplished by rotation of a socket which rotates the tips of the bare ends and twists together or couples the bare ends of the conductors.

Some of the prior art teaches that no need exists to pre-twist the bare ends of conducting wire prior to capping the bare ends of conductors with a twist-on connector of the type manufactured by Ideal Industries, Inc. under the trademarks or tradenames "Wire Nut" or "Wire Connector".

An object of the invention is to pre-twist bare ends of the conductors prior to capping the bare ends of conductors with a twist-on connector.

Another object of the invention is to make a connection between a plurality of conductors without reliance on a twist-on connector except insofar the twist-on connector acts as insulation.

Another object of the invention is to cap the pre-twisted conductors by applying the twist-on connector as insulation for the bare ends of the pre-twisted conductors.

Another object of the invention is to increase the area of contact between or among the bare ends of conductors, thereby reducing the fire hazard due to insufficient contact area between or among conductors.

Another object of the invention is to reduce the number of rotations required to make an electrical connection, thereby minimizing repetitive motion and/or repetitive strain which may be injurious to the hand, wrist and/or forearm.

Another object of the invention is to reduce the number of rotations required to make an electrical connection, thereby minimizing the time required to make the electrical connection.

Another object of the invention to provide a compact hand tool for twisting of wire or conductors in small compartments, tight spaces, or the like.

Another object of the invention is a tool which construction does not require costly adherence to close manufacturing tolerances. Manufacture of a pliers, forceps, or tongs with a grip has required adjustment by skilled personnel for the handles to be held securely in position in front of a socket. It is therefore desired to provide a mechanism that permits smooth rotation of the socket, reliably hold the conductors in position with respect to the socket, and that is less costly than the previously known corresponding mechanisms.

Another object of the present invention is to provide less expensive socket. Manufacture of a socket requires costly production of a special mold for a metal casting due to substantial torque demands. In comparison, a metal component which is commercially available off-the-shelf ("COTS") does not require a mold for metal casting. It is therefore desired to modify an standard socket, to provide an insert or the like of the appropriate size, shape, material, and thereby to achieve a less costly component.

BRIEF DESCRIPTION OF THE DRAWINGS

Similar reference numerals and characters refer to similar parts throughout the drawings.

DETAILED DESCRIPTION OF THE INVENTION

Figure 1:
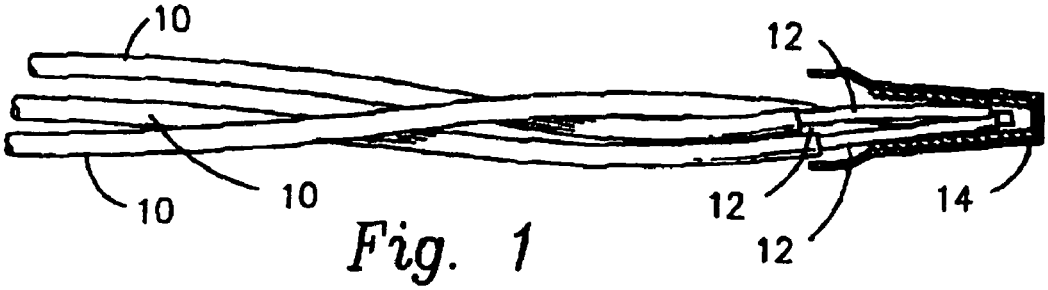
Fig. 1 PRIOR ART
FIG. 1 is a side view of a plurality of electrical wires joined by the wire connector operatively coupled thereto.

With reference to all the drawing figures: a plurality of electrical conductors are depicted by numeral 10; bare ends of the conductors are depicted by numeral 12, a tool is depicted by numeral 20 or 20'; and a twist-on connector is depicted by numeral 14.

Figure 2:
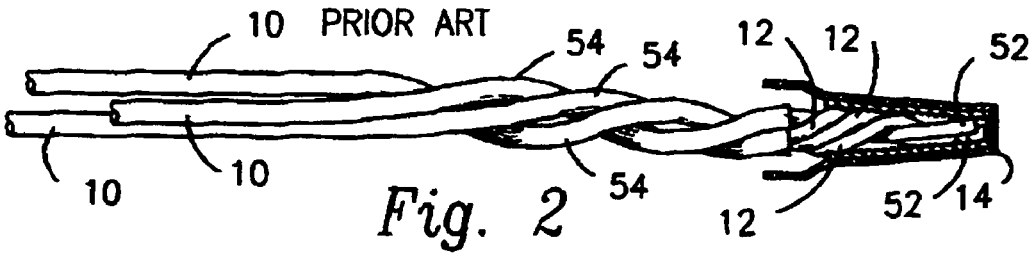
Fig. 2 PRIOR ART
FIG. 2 is a side view of a plurality of electrical wires joined by the wire twisting device with a wire connector operatively coupled thereto.

Referring to FIGS. 1 and 2, bare ends 12 of conductors 10 are coupled together by rotation of the twist-on connector 14. The bare ends 12 are not pre-twisted, and therefore, the electrical connection relies the twist-on connector. Additionally, referring to FIG. 2, the twisting of the conductors is not confined to the bare ends of the conductors but twisting is also shown in the insulated portion 54 of the conductors.

Figure 3A:
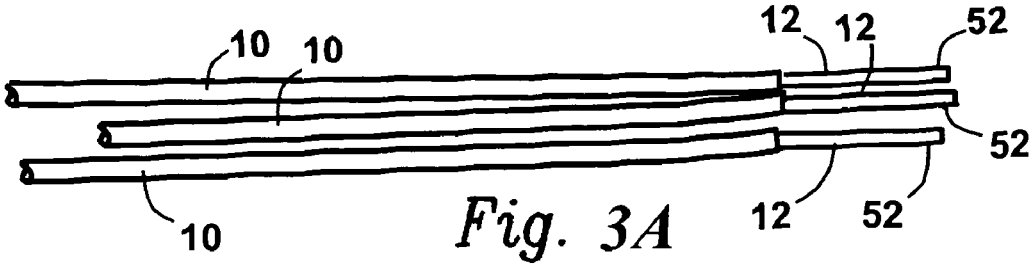
FIG. 3A is a side view of a plurality of electrical wires with ends stripped bare.
Figure 3B:
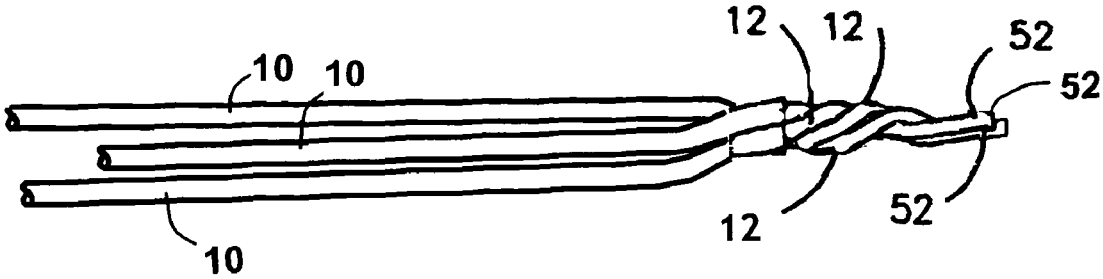
FIG. 3B is a side view of a plurality of electrical wires coupled together by the wire clamping and twisting device of the present invention.
Figure 3C:
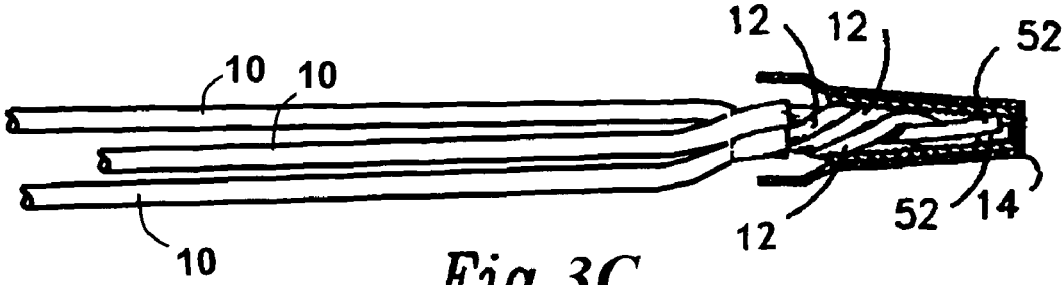
FIG. 3C is a side view of a plurality of electrical wires capped by a twist-on connector.
Figure 4:
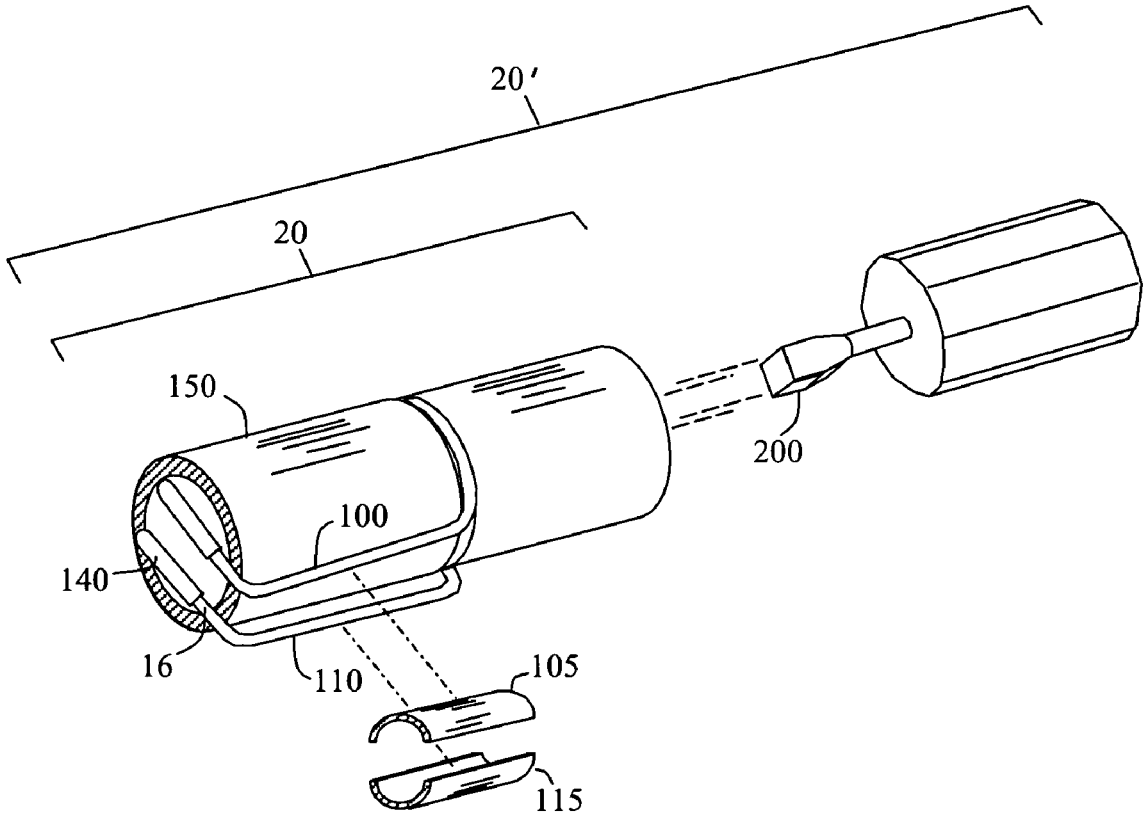
FIG. 4 is an exploded view of the invention.
Figure 5A:
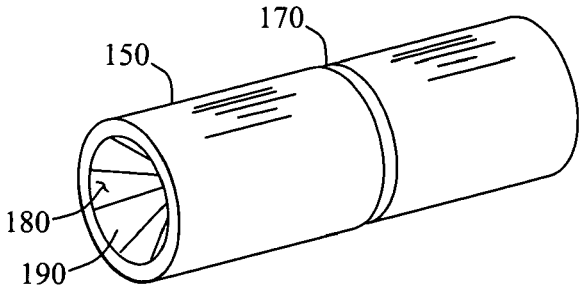
FIGS. 5A and 5B are perspective alternate views of the socket.
Figure 5B:
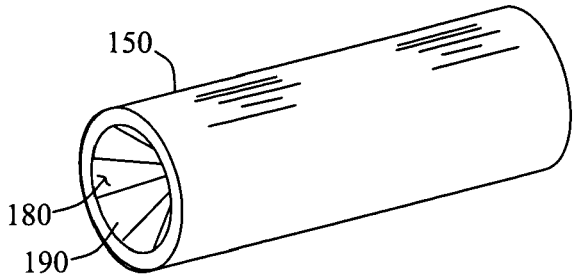
Figure 6:
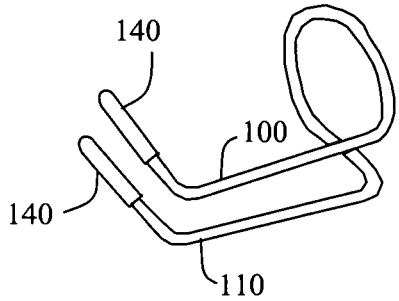
FIG. 6 is a perspective view of a continuous element comprising the handles and grips.
Figure 7A:
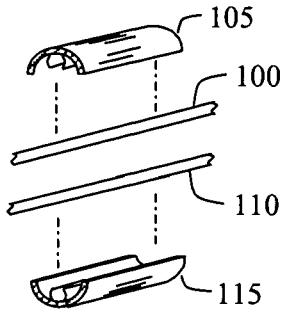
FIG. 7 is a perspective, exploded view of the handles which comprise a continuous element and tabs connected thereto.
Figure 7B:
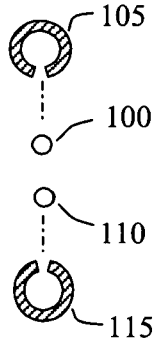
Figure 8A:
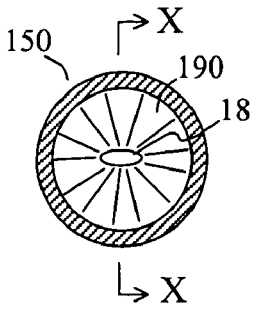
FIG. 8 show alternate front views of socket and the oblong space contained therein.
Figure 8B:
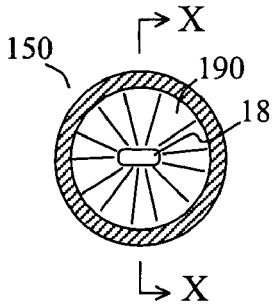
Figure 8C:
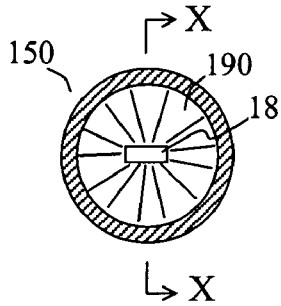
Figure 9A:
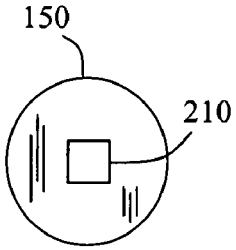
FIGS. 9A, 9B, and 9C show alternate end views of socket.
Figure 9B:
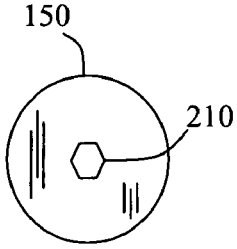
Figure 9C:
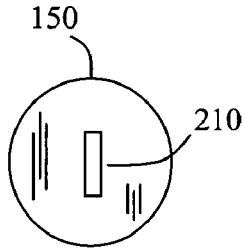
Figure 10A:
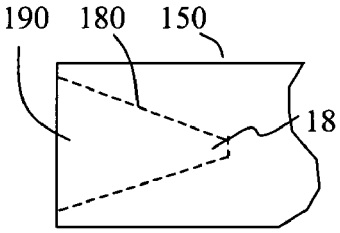
FIGS. 10A, 10B, and 10C are sectional views of the tool showing alternate profiles of the interior of the socket.
Figure 10B:
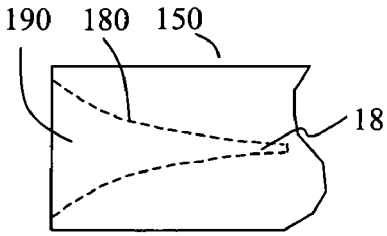
Figure 10C:
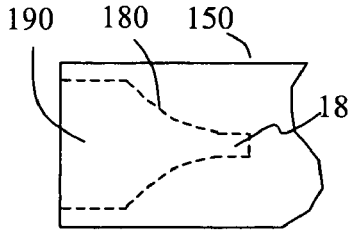

Referring to FIGS. 3A, 3B and 3C, the bare ends 12 are coupled together by a tool 20. In FIG. 3A, the conductors 10 are stripped to reveal bare ends 12 of conductors 10. In FIG. 3B, the bare ends 12 of conductors 10 are then coupled together by the tool 20 or 20'. In FIG. 3C, bare ends 12 of conductors 10 are capped by a twist-on connector 14. Since the bare ends 12 are pre-twisted, the electrical connection does not rely on the twist-on connector.

Referring to FIGS. 4 through 14, inclusive, the tool 20 has an upper handle 100, a lower handle 110, a socket 150 for receiving bare ends 12 of conductors 10; and a pair of grips 16 for clamping the conductors 10. The grips 16 are located in front of the socket. In the preferred embodiment, referring to FIGS. 4 to 10, the upper and lower handles 100 and 110 and the grips 16 are formed by a continuous element which encircles the socket 150, then extends along the remaining length of the socket, and then bends at about a right angle (or 90 degrees) before terminating in front of the socket. The continuous element may be made of metallic wire, rod, or the like. The interior of the socket 190 is shaped to receive bare ends 12 of the conductors 10. The interior of the socket 190 has a profile 180 which may be sloped, curved, conic, parabolic, or hyperbolic. The tips 52 of the bare ends 12 are received by an oblong space 18 within the interior of the socket. The oblong space 18 may have the shape of an ellipse, oval, rectangle with rounded corners, slotted hole, or the like. The length of the oblong space 18 is at least 2 times the diameter of the conductor; the length of the opening is typically 2 to 4 times the diameter of a 12 ga wire. The width of the oblong space 18 is less than 2 times the diameter of the conductor; the width of the oblong space is typically 1 to 2 times the diameter of a 12 ga wire. The depth of the oblong space 18 may be relatively shallow or be relatively deep. The width and/or depth of the oblong space 18 may be fixed or the width and/or depth may narrow as a function of depth such as the profile of a wedge, obelisk, or a conic, parabolic, or hyperbolic volume. Referring to FIGS. 10A to 10C, the cross-section (X-X) of the socket 150 shows alternative profiles 180 of the interior 190 of the socket.

In the preferred embodiment, there is a plurality of conductors 10 which are composed of solid wire of size 12 to 14 gauge covered by insulation. The plurality of conductors ranges from 2 to 3 conductors in number. There are four wires or conductors. In still another embodiment, the conductors 10 have varying size from 10 to 16 gauge wire. In still yet another embodiment, there are conductors comprising braided and/or solid wire.

In the preferred embodiment, a composite tool 20' comprises the tool 20 and a driver 200 for rotation of the socket 150 by insertion of the driver in a hole 210. The driver 200 may be a ratchet driver, a screwdriver, a nut driver, a grip driver, a hex key, a hex bit, or any device capable of rotation of the socket 150. Such drivers are of the type manufactured by Sears Roebuck Co. of Chicago, Ill. under the trademark or tradename "Craftsman." The hole 210 may be sized for a ⅜ in, ¼ in, or ½ drive or another shape such as flat, hex, or square shank. Alternatively, the driver 200 may be a variable drill or other power tool with corresponding drive adapter inserted and locked in a chuck of the power tool.

In operation, the socket 150 receives the bare ends 12 of the conductors 10. The tips 52 of the conductors are guided or funneled into the oblong space 18 therein. The oblong space holds the tips 52 and makes the tips comply with the rotation of the socket such that the tips 52 rotate through the approximately the same number of radians as the socket 150. The handles 100 and 110 are pressed together, thereby clamping the conductors 10 between grips 16 and preventing rotation of conductors while allowing rotation of the socket 150 and bare ends 12 of the conductors 10. The grips 16 are capable of exerting sufficient force on the conductors to firmly hold the conductors but not exerting excessive force which could damage the insulation of the conductors. The force exerted by the grips is similar to the force exerted by a surgeon's forceps, laboratory tongs, or jeweler's pliers. The grips 16 press the conductors 10 between the grips 16 of the handles 100 at a pre-determined distance from the bare ends 12 of the conductors which may range from ⅜ to 2 inches. The pre-determined distance is typically ranges from ½ to 1 inches. Rotating the driver 200 rotates the socket 150 and thus rotates the bare ends 12 of the conductors 10. The grips 16 firmly hold the conductors and restrain rotation at a pre-determined distance. After from ¾ rotations to 2 rotations (or from $3\pi/2$ to $4\pi$ radians), the bare ends 12 of the conductors 10 are twisted. The handles 100 and 110 may be opened to allow release the conductors 10. Finally, the twist-on connector 14 may be used to cap the bare ends 12 of the pre-twisted conductors.

Referring to FIGS. 4 to 7, tabs 105 and 115 are attached to handles 100 and 110 to widen the handles. The upper and lower handles 100 and 110 are formed from a single wire wrapped around a circumferential groove 170 in the socket 150 and pads 140 cover the ends of the grips 16. The pads 140 may be made of rubber, vinyl, plastic or similar material. Referring to FIG. 5B, in another embodiment, the socket lacks a circumferential groove.

In another embodiment, the handles 100 and 110 are pressed together, or towards each other, by a separate tool such as a tongs, pliers, vicegrips, or clamp. In still yet another embodiment, a latch may be closed when handles 100 and 110 are pressed together, or towards each other.

Figure 11:
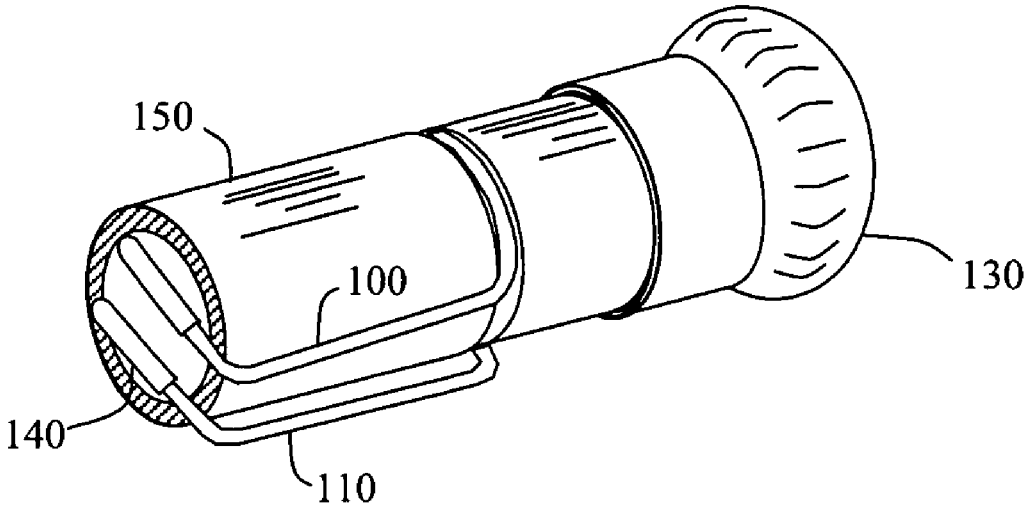
FIG. 11 is a perspective view of a tool with knob connected thereto.
Figure 12:
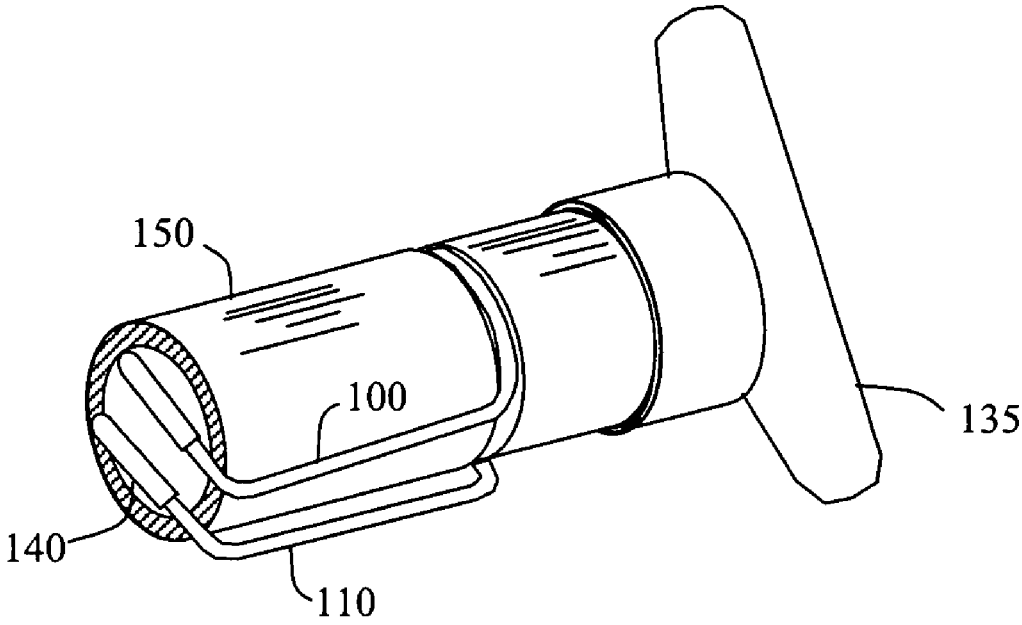
FIG. 12 is a perspective view of a tool with wings connected thereto.

Referring to FIGS. 11 and 12, representing another embodiment, a knob 130 may be attached to the socket 150 to provide sufficient torque without the need of an additional tool to rotate the socket. Rotating the knob 130 rotates the socket 150 and thus rotates the bare ends 12 of the conductors 10. The knob may have an ergonomic shape and/or have a comfortable, slip-resistant cushion grip. The knob may be removably attached or permanently attached to the socket. In still another embodiment, wings or fins or a T-shaped handle 135 may be attached to the socket 150 to provide sufficient torque without the need of an additional tool to rotate the socket.

Figures 13, 13A, 13B, 13C:
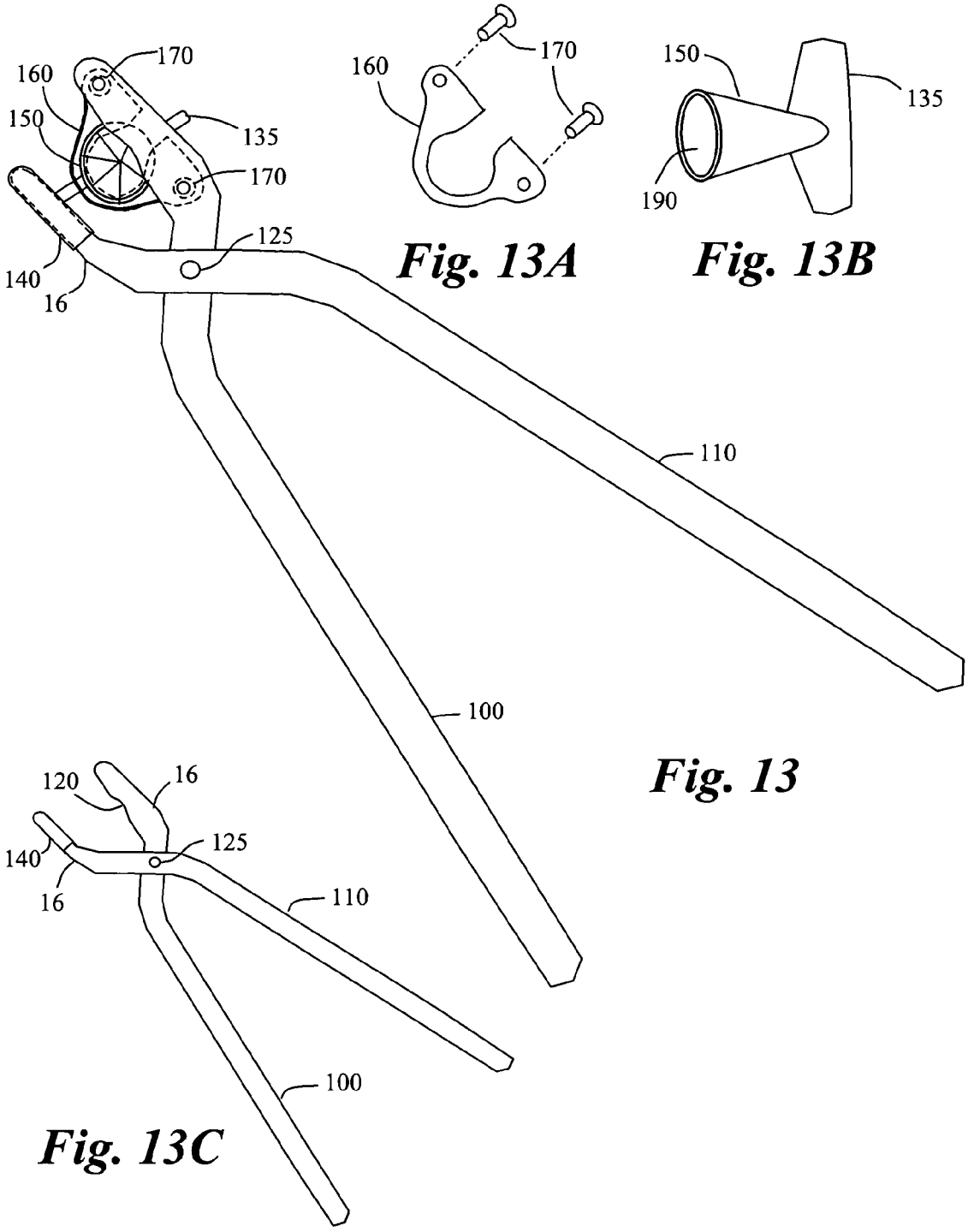
FIG. 13 is a perspective view of an alternative embodiment of the invention.
FIGS. 13A, 13B, and 13C are additional views which illustrate the embodiment of the invention.
Figure 14:
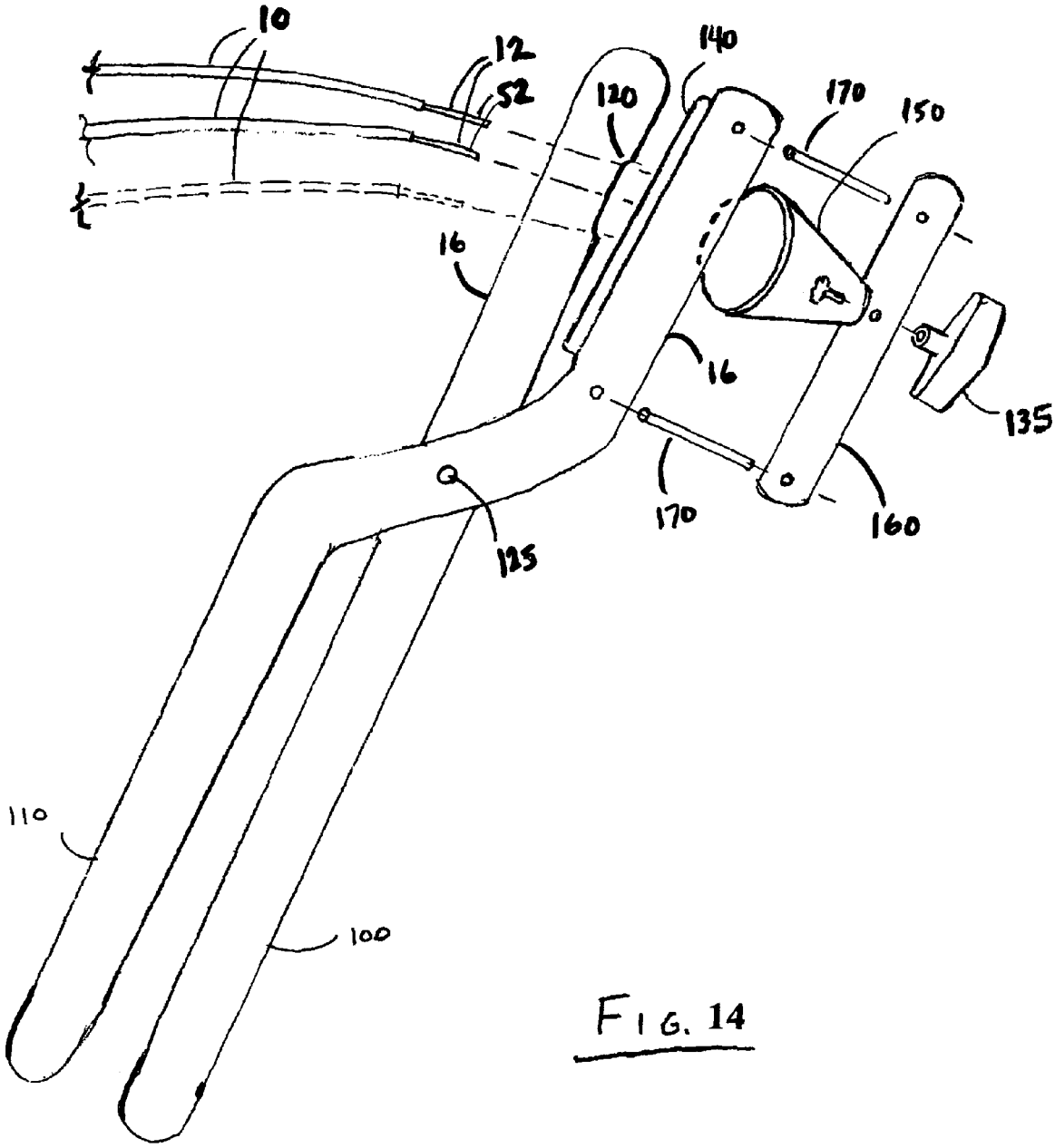
FIG. 14 is a perspective view of another alternative embodiment of the invention.

Referring to FIGS. 13 and 14, inclusive, the tool 20 or 20' has an upper handle 100, a lower handle 110, a socket 150 for receiving bare ends 12 of conductors 10; a knob 130 for rotating the socket. The upper handle 100 and lower handle 110 are rotatably connected by a pin 125. In this embodiment, the grips 16 of the handles resemble forceps and the socket is connected to one of the handles by a retaining element 160. Pins 170 connect the retaining element 160 to at least one of the handles. In another embodiment, there exists a cavity 120 in upper handle 100 and/or lower handle 110. The cavity 120 is capable of receiving a plurality of conductors 10. The upper handle 100 has a pad 140 along a portion of its length. In another embodiment, there exists a cavity 120 in upper handle 100 and/or lower handle 110. The cavity 120 is capable of receiving a plurality of conductors 10. Alternatively, the tool 20 may a forceps connected to the socket by the retaining element 160 which may take the form of a chain, clasp, or other retaining means.

In operation, referring to FIGS. 13 and 14, the retaining element 160 retains the socket 150 in position to receive the bare ends 12 of the conductors. The pad 140 which presses the conductors 10 against the upper handle 100 (or lower handle 110) which holds the conductors in fixed position at a pre-determined distance from the bare ends 12 of the conductors. Rotating the socket 150 thus rotates the bare ends 12 of the conductors 10. After from ¾ rotations to 2 rotations (or from $3\pi/2$ to $4\pi$ radians), the bare ends 12 of the conductors 10 are twisted. The grips 16 of the handles 100 and 110 may be separated to release the conductors 10. Finally, the twist-on connector 14 may be used to cap the bare ends 12 of the pre-twisted conductors.

From the foregoing it will be appreciated that although specific embodiments of the invention have been described herein for purposes of illustration, various modifications may be made without deviating from the spirit and scope of the invention. For example, the interior of the socket may take the form of a multi-sided prismatic volume or other irregular volume. The interior of the socket may be smooth or have groves, blades, or ridges to facilitate rotation of the bare ends of the conductors. The handles and knob may be designed with consideration of various factors including ergonomics and safety and thus constructed with insulating material. Further, the invention can be used with solid and braided wires made of copper or aluminum as well as alloys such as brass, stainless steel, nitinol and so on. Accordingly, the invention should be broadly construed and should not be limited except as to the appended claims.

What is claimed is:

1. A device for twisting and clamping conductor wires comprising:

a socket for receiving a plurality of wires to be twisted wherein each wire has at least one end which is stripped bare a distance of at least ⅜inches from the end;

wherein the interior of the socket has an interior that is at least 1 inches in depth;

wherein the interior of the socket has an opening dimensioned such that when a wire connector is inserted and seated in the socket and the plurality of wires is inserted in the wire connector, rotating the socket about the socket's axis of symmetry transmits rotary motion to the wire connector and the plurality of wires contained therein;

wherein the interior of the socket converges near its inner most point to an oblong cross-section dimensioned such that when the ends of the wires are fully inserted into the socket, the ends of the wires are held in closely spaced relation and rotating the socket about the socket's axis of symmetry transmits rotary motion to the ends of the wires;

wherein the socket is shaped to receive wherein the oblong cross-section has a narrowest cross-dimension larger than that of a single 12 gage wire and smaller than that of two 14gage wires positioned side-by-side;

wherein the socket is rotatably-coupled about the socket's axis of symmetry to a clamping means;

wherein the clamping means is removably coupled to the socket; and wherein the clamping means has a least one handle with a first grip and a second grip that are capable of restraining the rotation of the wires when the socket is rotated about the socket's axis of symmetry.

* * * * *